US006298705B1

(12) United States Patent
Shore

(10) Patent No.: US 6,298,705 B1
(45) Date of Patent: Oct. 9, 2001

(54) METHOD AND APPARATUS FOR ROLLING CONCRETE REINFORCING ELEMENTS

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/491,857

(22) Filed: Jan. 26, 2000

(51) Int. Cl.[7] ..... B21H 8/00
(52) U.S. Cl. ..... 72/187; 52/740.3
(58) Field of Search ..... 52/740.3, 740.5; 72/187, 197, 198, 235

(56) References Cited

U.S. PATENT DOCUMENTS

| | | | | |
|---|---|---|---|---|
| 786,794 | | 4/1905 | Barrett . | |
| 858,517 | * | 7/1907 | Johnson | 52/740.3 |
| 1,164,477 | * | 12/1915 | Dale et al. | 52/740.3 |
| 1,458,381 | | 6/1923 | Baehr . | |
| 2,394,183 | | 2/1946 | Jaecker et al. . | |
| 2,821,727 | * | 2/1958 | Corckran | 72/187 |
| 3,186,206 | | 6/1965 | Gillberg . | |
| 3,214,877 | | 11/1965 | Akin . | |
| 3,641,799 | | 2/1972 | Wildt . | |
| 3,653,245 | | 4/1972 | Tishken . | |
| 4,034,587 | | 7/1977 | Schwarz . | |
| 4,953,379 | | 9/1990 | Richartz . | |

FOREIGN PATENT DOCUMENTS

| | | |
|---|---|---|
| 725636 | 4/1955 | (DE) . |
| 965275 | 7/1964 | (DE) . |
| 1378569 | 12/1974 | (EP) . |
| 597888 | 12/1925 | (FR) . |
| 1532713 | 7/1968 | (FR) . |

* cited by examiner

*Primary Examiner*—Lowell A. Larson
(74) *Attorney, Agent, or Firm*—Samuels, Gauthier & Stevens

(57) ABSTRACT

Round bars are successively rolled through first and second roll passes. Each roll pass is defined by a pair of work rolls having cylindrical rolling surfaces with notches therein extending transversely and obliquely with respect to the rolling line, and with the roll axes defining the second roll pass being offset at 90 with respect to the roll axes defining the first roll pass. The first pair of work rolls is arranged to configure the round bar into an intermediate process section having flat parallel first sides with first ribs protruding therefrom, and the second pair of work rolls is arranged to reconfigure the process section into a finished concrete reinforcing element having flat parallel sides which are perpendicular to the first parallel sides and which have second ribs protruding therefrom.

8 Claims, 2 Drawing Sheets

METHOD AND APPARATUS FOR ROLLING CONCRETE REINFORCING ELEMENTS

BACKGROUND OF THE INVENTION

1. Field of the Invention

This invention relates generally to continuous hot rolling mills for so-called "long" products such as bars, rods, and the like, and is concerned in particular with an improved method and apparatus for rolling concrete reinforcing elements.

2. Description of the Prior Art

As disclosed for example in U.S. Pat. No. 4,953,379 (Richartz), it is know to employ two successive two roll passes to roll round bars into concrete reinforcing elements having circular core cross sections with protruding ribs or fins. In U.S. Pat. No. 3,641,799 (Wildt), a similar arrangement is employed to roll indentations into the bar, the resulting product again having a circular core cross section. Because of their circular core cross sections, such products are subjected to relatively high bending stresses. They also exhibit a tendency to twist when being formed into structural shapes in automatic so-called "stirrup" machines. Moreover, where the roll passes used to roll the circular cross sections are defined by conventional grooves, the process of grinding the notches which form the rebar ribs into the grooves is difficult, time consuming, and expensive. The conventional grooves are also prone to rapid wear because of pronounced forward slip.

As disclosed in U.S. Pat. No. 1,458,381 (Baehr) and U.S. Pat. No. 4,034,587 (Schwarz), it is also known to roll reinforcing bars with either circular or square core cross sections using single four roll passes. The rolling of reinforcing bars with round core cross sections results in the disadvantages noted above. Moreover, the rolls of four roll passes require precise adjustment, and are necessarily dedicated to the rolling of only one product size. Thus, normal wear and/or changes in product sizes will necessitate frequent mill shut downs to accommodate roll changes. U.S. Pat. No. 3,214,877 (Akin) teaches the rolling of square or round bars into flat sided and ribbed process sections which can then drawn through dies to produce the finished products. This method is labor intensive and unduly expensive.

An objective of the present invention is to obviate the drawbacks and disadvantages of the prior art by providing an improved two-roll, two-pass method and apparatus for hot rolling round bars into reinforcing elements having flat sided cores with ribs or the like protruding from the flat sides thereof. The cores will typically be a square, but other shapes including for example, rectangles, are also possible.

A companion objective of the present invention is to produce the aforesaid ribbed flat sided corse by taking only modest reductions on the order of 10–15% in each successive roll pass, thereby reducing groove wear and prolonging useful roll life.

SUMMARY OF THE INVENTION

In a preferred embodiment of the method and apparatus of the present invention, a round bar is rolled through first and second pairs of driven work rolls arranged in succession along a rolling line. The rolls of the first roll pair have notched cylindrical rolling surfaces arranged to configure the round bar into an intermediate process section having first parallel ribbed flat sides. The rolls of the second roll pair also have notched cylindrical rolling surfaces arranged to configure the process section into a finished concrete reinforcing element having second parallel ribbed flat sides perpendicular to the first ribbed flat sides, thereby defining a quadrilateral core which preferably although not necessarily will comprise a square.

These and other objectives, features and advantages of the present invention will now be described in greater detail with reference to the accompanying drawings, wherein:

DETAILED DESCRIPTION OF PREFERRED EMBODIMENT

Figure 1:
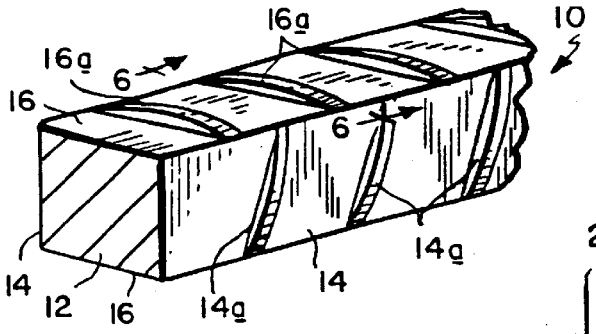
FIG. 1 is a view in perspective of a reinforcing element produced by the method and apparatus of the present invention.
Figure 6:
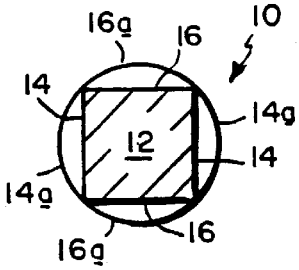
FIG. 6 is a cross sectional of the finished reinforcing element taken along line 6—6 of FIG. 1.

Referring initially to FIGS. 1 and 6, a concrete reinforcing element produced by the method and apparatus of the present invention is shown at 10. The reinforcing element 10 has a square core 12 defined by parallel first flat sides 14 with first ribs 14*a* protruding therefrom, and parallel second flat sides 16 perpendicular to the sides 14 with second ribs 16*a* protruding therefrom. The first and second ribs 14*a*, 16*a* define a generally circular profile surrounding the centrally located square core 12.

Figure 2:
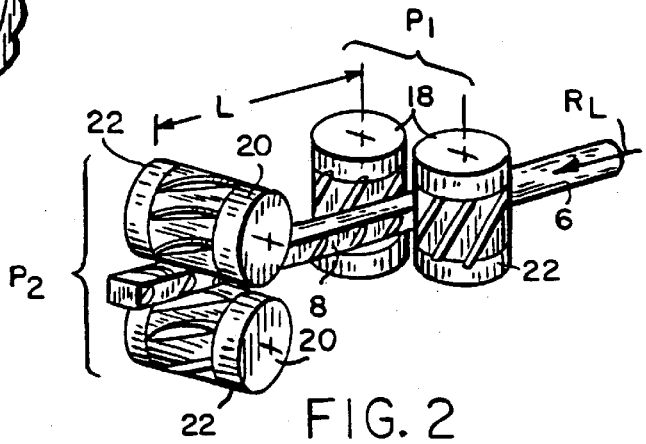
FIG. 2 is a diagrammatic perspective view of the first and second roll passes of an apparatus in accordance with the present invention.
Figure 3:
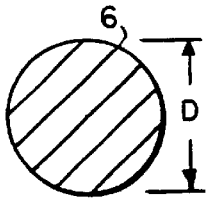
FIG. 3 is a cross sectional view of the incoming round entry section.
Figure 7:
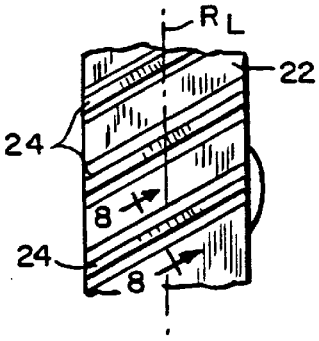
FIG. 7 is a plan view of a typical flat rolling surface with notches extending transversely with respect to the rolling line.
Figure 8:
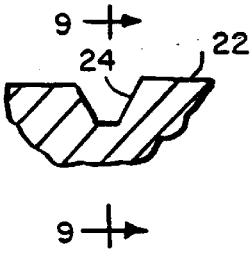
FIG. 8 is a sectional view on an enlarged scale taken along line 8—8 of FIG. 7.
Figure 9:
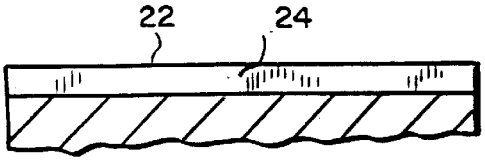
FIG. 9 is a sectional view taken along line 9—9 of FIG. 8.

With reference to FIG. 2, the apparatus of the present invention comprises first and second pairs of driven work rolls 18, 20 respectively defining roll passes $P_1$, $P_2$, arranged in succession along a rolling line $R_L$. The work rolls of each roll pair have cylindrical rolling surfaces 22. As can best be seen in FIGS. 7 and 8, the cylindrical rolling surfaces 22 have notches 24 extending transversely across and at an oblique angle with respect to the rolling line $R_L$. The axes of the rolls 20 are offset by 90 with respect to the axes of rolls 18.

In accordance with the present invention, a round entry section 6 emerging from a conventional bar mill (not shown), and while still at an elevated rolling temperature of for example about 950 ° C., is rolled continuously through roll passes $P_1$, $P_2$.

Figure 4:
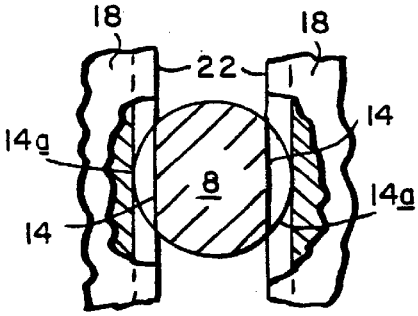
FIG. 4 is a cross sectional view through the first roll pass.

As shown in FIG. 4, the notched cylindrical rolling surfaces 22 of the rolls 18 in pass $P_1$ configure the round entry section into an intermediate process section 8 having the flat parallel first sides 14 and ribs 14*a*.

Figure 5:
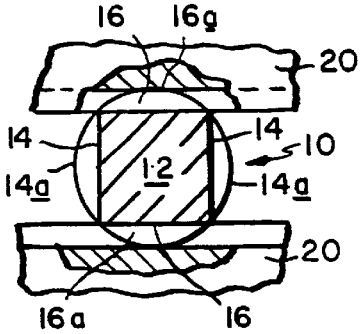
FIG. 5 is a cross sectional view through the second roll pass.

In the second roll pass $P_2$, as shown in FIG. 5, the intermediate process section 8 is reconfigured into the finished reinforcing element 10, with flat parallel second sides 16 and second ribs 16*a*, the sides 14, 16 cooperating to define the square core 12, and the ribs 14*a*, 16*a* defining a generally circular profile, all as shown in FIG. 6.

Although not shown, it will be understood that the rolls 18, 20 of the successive roll passes $P_1$, $P_2$ may be supported in cantilever fashion on the ends of roll shafts, the latter being symmetrically adjustable and driven via four gear clusters in a manner well known to those skilled in the art, as depicted for example in U.S. Pat. No. Re. 28,107 (Wilson et al.). Advantageously, the rolls 18, 20 may be substituted for the grooved rolls of the last two passes in a reducing/sizing mill of the type described in U.S. Pat. No. 5,325,697 (Shore et al.). The disclosures of both U.S. Pat. Nos. Re. 28,107 and 5,325,697 are herein incorporated by reference in their entirety.

The reductions effected in each of the passes $P_1$ and $P_2$ will typically range between 10–15%. In order to avoid twisting of the intermediate process section 8, the spacing L between the roll passes $P_1$, $P_2$ is governed by the expression $$\frac{L}{D} < 30$$

where D=diameter of the round entry section 6.

Figure 10:
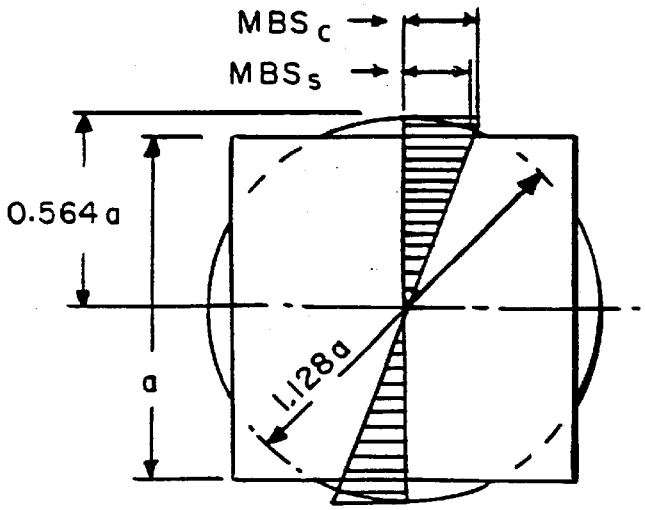
FIGS. 10 and 11 are schematic comparisons of square and circular core depicting various advantages of the former as compared to the latter.

A number of advantages are realized by producing the reinforcing elements with square cores, as compared to the more conventional round cores. For example, and with reference to FIG. 10, a square cross section of a reinforcing element in accordance with the present invention is shown superimposed over a round core of a conventional reinforcing element. Assuming that both cores have the same cross sectional area and weight, if "a" is the length of a side of the square core, then the circular core will have a radius of 0.564a and a diameter of 1.128a. The perimeters of both cores are thus:

Perimeter of square core=4×a=4a

Perimeter of circular core=3.14×1.128a=3.542a

Therefore, $$\frac{4a}{3.542a} = 1.129$$

which means that for the same cross sectional area, the square core has 12.9% more adhesion area available for contact with the concrete in which it is to be embedded. Moreover, given the fact that the square core will be bent in a direction perpendicular to two opposing sides, its maximum bending stress $MBS_S$ will be 12.8% less than the maximum bending stress $MDS_C$ of a comparable circular core. Thus, the square core will have more holding power when embedded in concrete, and less tendency to crack when being bent into structural shapes. Also, because the flat parallel sides of the square core can be positively gripped by the bending rolls, there is less tendency for the bar to twist while it is being bent into various structural shapes.

Figure 11:
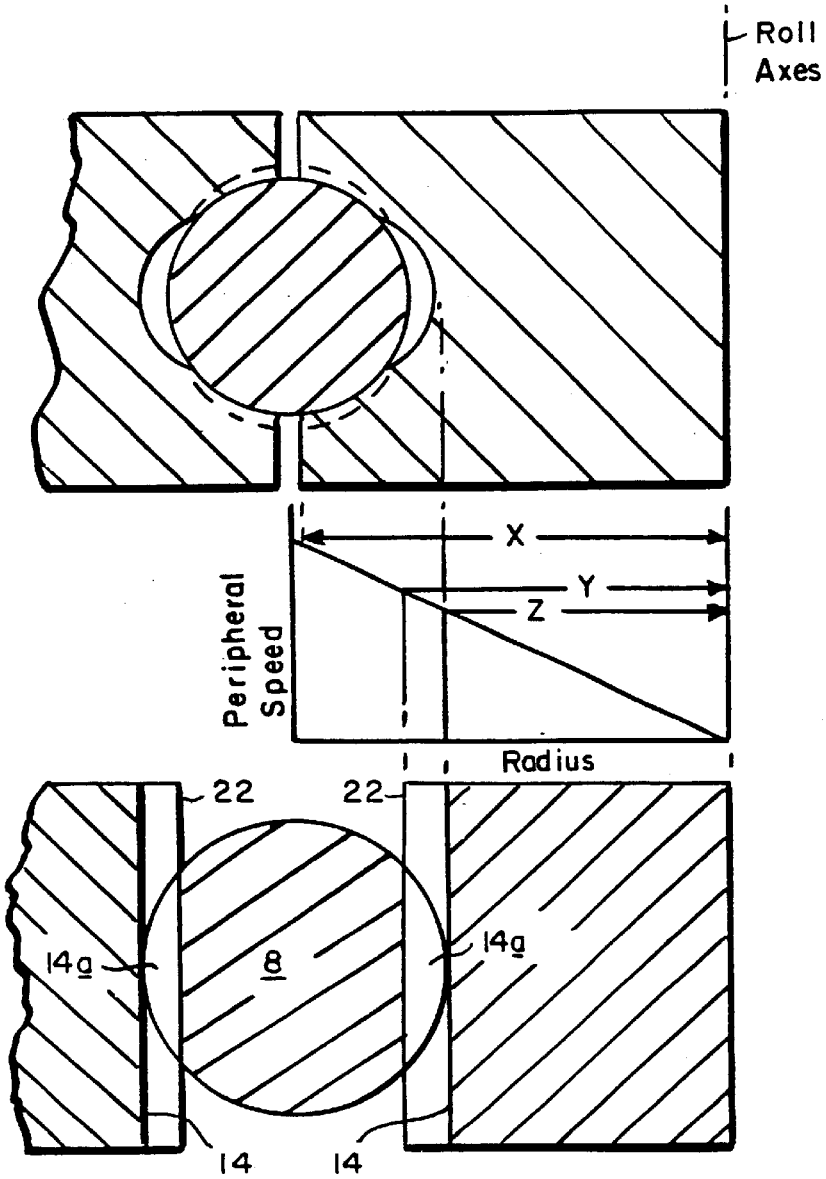

Referring additionally to FIG. 11, it will be seen that when rolling a circular cross section with conventional grooved rolls, there is a significant difference between the maximum peripheral speed "x" at the roll surface and the minimum peripheral speed "z" at the bottom of the roll groove. This gives rise to substantial differences in the forward slip of the product relative to the groove surfaces, which in turn accelerates groove wear. By comparison, the cylindrical surfaces of the rolls used to roll square cross sections have a lower peripheral speed "Y", with a lower slip differential between "Y" and "Z", and are thus less prone to rapid wear. The notches 24 in the cylindrical rolling surfaces 22 of the work rolls are easily ground, thus facilitating not only the initial supply of the work rolls, but also their regrinding as part of normal mill maintenance procedures. The relatively modest reductions on the order of 10–15% advantageously minimize wear of the notches 24, thereby increasing the tonnage that can be rolled before replacing the work rolls.

In light of the foregoing, it will be understood by those skilled in the art that various changes and modifications may be made to the disclosed method and apparatus without departing from the scope of the invention as defined by the appended claims. For example, the configuration and spacing of the notches 24 and the ribs produced thereby may differ to accommodate varying specifications and requirements. The configuration of the core section may also be varied to include other flat sided shapes, including rectangles. The work rolls 18, 20 may be mounted either in cantilever fashion on roll shafts, or straddle mounted between bearings supporting the roll shafts. Means may be included for varying the parting between the work rolls in order to accommodate different product sizes.

I claim:

1. Apparatus for hot rolling a round bar into a concrete reinforcing element, said apparatus comprising: first and second pairs of driven work rolls arranged in succession along a rolling line, the work rolls of each of said pairs having cylindrical rolling surfaces with notches therein extending transversely and obliquely with respect to the rolling line, the roll axes of said second pair being offset by 90° with respect to the roll axes of said first pair, said first pair of work rolls being arranged to configure said round bar into an intermediate process section having flat parallel first sides with first ribs protruding therefrom, and said second pair of work rolls being arranged to reconfigure said process section into a finished concrete reinforcing element having a core with flat parallel second sides which are perpendicular to said first parallel sides and which have second ribs protruding therefrom.

2. The apparatus as claimed in claim 1 wherein said first and second ribs define a generally circular cross sectional profile.

3. The apparatus as claimed in claim 1 wherein said core is square.

4. The apparatus as claimed in claim 1 wherein said core is a rectangle.

5. The apparatus as claimed in claim 1 wherein the spacing L between said first and second roll pairs is governed by the expression $$\frac{L}{D} < 30$$

where D is the diameter of said round bar.

6. A method of hot rolling a round bar into a concrete reinforcing element, said method comprising: successively rolling said round bar through first and second roll passes, each of said roll passes being defined by a pair of work rolls having cylindrical rolling surfaces with notches therein extending transversely and obliquely with respect to the rolling line, the roll axes defining said second roll pass being offset at 90° with respect to the roll axes defining said first roll pass, said first pair of work rolls being arranged to configure said round bar into an intermediate process section having flat parallel first sides with first ribs protruding therefrom, and said second pair of work rolls being arranged to reconfigure said process section into a finished concrete reinforcing element having flat second parallel sides which are perpendicular to said first parallel sides and which have second ribs protruding therefrom.

7. A method of hot rolling a round bar into a concrete reinforcing element, said method comprising: rolling said round bar through first and second two roll passes arranged successively along a rolling line, the rolls of said first roll pass having notched cylindrical rolling surfaces arranged to configure said round bar into an intermediate process section having first parallel ribbed flat sides, and the rolls of said second roll pass having notched cylindrical rolling surfaces arranged to reconfigure said process section into a finished concrete reinforcing element having second parallel ribbed flat sides cooperating with said first ribbed flat sides to define a square core.

8. The method of claims 6 or 7 wherein said first and second ribs are configured and arranged to define a generally circular cross sectional profile.

* * * * *